US009347740B2

(12) United States Patent
Dove

(10) Patent No.: US 9,347,740 B2
(45) Date of Patent: May 24, 2016

(54) ARM STABILIZER AND METHODS OF USE

(71) Applicant: Elmer Ray Dove, Keyser, WV (US)

(72) Inventor: Elmer Ray Dove, Keyser, WV (US)

( * ) Notice: Subject to any disclaimer, the term of this patent is extended or adjusted under 35 U.S.C. 154(b) by 200 days.

(21) Appl. No.: 14/154,345

(22) Filed: Jan. 14, 2014

(65) Prior Publication Data

US 2014/0203054 A1 Jul. 24, 2014

Related U.S. Application Data

(60) Provisional application No. 61/754,035, filed on Jan. 18, 2013.

(51) Int. Cl.

| | |
|---|---|
| ***A45F 3/14*** | (2006.01) |
| ***A45C 15/00*** | (2006.01) |
| ***F41C 33/00*** | (2006.01) |
| ***F41B 5/14*** | (2006.01) |

(52) U.S. Cl.

CPC ..... *F41C 33/001* (2013.01); *F41B 5/148* (2013.01); *F41B 5/1426* (2013.01); *F41C 33/002* (2013.01)

(58) Field of Classification Search

CPC ..... F41C 33/001; F41C 33/002; F41C 23/02; F41C 27/22; F41A 99/00; F41B 5/1426; F41B 5/148

USPC ..... 224/257, 258, 150, 916, 578, 911, 913; 42/94, 85, 1.06; 473/208; 124/23.1, 86

See application file for complete search history.

(56) References Cited

U.S. PATENT DOCUMENTS

| | | | | |
|---|---|---|---|---|
| 1,383,125 | A * | 6/1921 | Kennedy, Jr. | F41C 33/001 224/150 |
| 1,396,270 | A * | 11/1921 | Grierson | F41C 33/001 224/150 |
| 2,112,577 | A * | 3/1938 | Roberts | F41C 23/16 42/85 |
| 2,357,363 | A * | 9/1944 | Smith | F41C 233/001 224/150 |
| 2,779,521 | A * | 1/1957 | Granberg | F41C 33/002 224/150 |

(Continued)

*Primary Examiner* — Justin Larson
*Assistant Examiner* — Lester L Vanterpool
(74) *Attorney, Agent, or Firm* — Mathew L. Grell; Grell & Watson Patent Attorneys

(57) ABSTRACT

A arm stabilizer configured with a stretchable elastic member having a first end and a second end, an adjustable shoulder sling hingedly connected to the first end of said stretchable member, and a fixed hand sling hingedly connected to the second end of the stretchable member and, thus configured to be worn by a marksman with an extended aiming and firing arm and is not affixed to the firearm, is light in weight, easy to transport, and quick installation enables stabile aiming and firing accurately at a target.

14 Claims, 7 Drawing Sheets

(56) References Cited

U.S. PATENT DOCUMENTS 2,812,123 A * 11/1957 Girton ..... A47D 13/086 224/150
2,985,980 A * 5/1961 Broshous ..... F41C 23/12 42/94
3,055,354 A * 9/1962 Gates ..... F41B 5/14 124/23.1
3,553,878 A * 1/1971 Canon ..... F41A 23/02 42/72
3,572,312 A * 3/1971 Foster ..... F41B 5/14 124/23.1
3,927,808 A * 12/1975 Steen ..... F41C 23/02 224/267
4,249,686 A * 2/1981 Morwood ..... F41C 33/002 224/150
4,515,301 A * 5/1985 A'Costa ..... F41C 23/02 224/637
4,542,840 A * 9/1985 Pepper, Sr. ..... F41C 33/001 224/150
4,714,071 A * 12/1987 Saunders ..... F41B 5/14 124/88
4,751,896 A * 6/1988 Miley ..... A47D 13/086 119/770
5,056,253 A * 10/1991 Willumsen ..... F41C 33/001 42/94
5,065,732 A * 11/1991 Smith ..... F41B 5/1461 124/23.1
5,082,155 A * 1/1992 Salvador ..... F41C 33/001 224/150
5,149,099 A * 9/1992 Radakovich ..... A63B 69/0059 473/208
5,165,584 A * 11/1992 Meagher ..... A45F 3/14 124/88
5,353,538 A * 10/1994 Hakedal ..... F41C 23/02 224/150
5,487,374 A * 1/1996 Herminath ..... F41B 5/14 124/86
5,715,979 A * 2/1998 Crandall ..... F41C 23/02 224/150
6,029,321 A * 2/2000 Fisher ..... F41C 33/001 124/35.2
6,783,464 B1 * 8/2004 Romano ..... A63B 69/3608 473/208
7,959,046 B2 * 6/2011 Burnsed, Jr. et al. . F41C 33/001 224/150
8,430,285 B2 * 4/2013 Burnsed, Jr. ..... F41C 23/02 224/150
2001/0046904 A1 * 11/2001 Arvanitis, Jr. ..... A63B 69/0059 473/208
2007/0278261 A1 * 12/2007 Gallagher ..... F41C 33/001 224/150
2010/0242335 A1 * 9/2010 Duval ..... F41C 33/001 42/94
2012/0255976 A1 * 10/2012 Dees ..... F41C 33/002 224/150

* cited by examiner

ARM STABILIZER AND METHODS OF USE

CROSS REFERENCE TO RELATED APPLICATIONS

To the full extent permitted by law, the present United States Non-Provisional patent application claims priority to and the full benefit of United States Provisional patent application entitled "Arm Stabilizer", filed on Jan. 18, 2013, having assigned Ser. No. 61/754,035, incorporated entirely herein by reference.

TECHNICAL FIELD

The disclosure relates generally to stabilizers and more specifically it relates to a shoulder sling and hand strap mechanism to help keep your extended arm steady and stabilize.

BACKGROUND

The need to stabilize an extended aiming and firing arm is well known in archery and firearm execution. Three dimensional forces arise in all directions about the archery and firearm creating inherent instability in the accuracy of executing the archery and firearm mechanism. For example, an archer must hold the bow one-handed at a full arm extension while drawing the bowstring with the opposing arm to the full extension of the bowstring. The archer must then attempt to hold the bowstring at full extension while aligning the sighting device with the target. The archer then releases the bowstring while attempting to keep the bow steady and level until the arrow leaves the arrow rest. However, the drawing back of a bow string, by an archer, introduces counteracting forces of twisting, pushing, and pulling which in turn creates the inherent instability while aiming and/or firing the bow. Furthermore, these counteracting forces make it difficult to maintain a target site without any upwardly, downwardly, backwardly, up and down, or side-to-side movement of the bow throughout target sighting, drawing and releasing of the archery arrow. In addition, translational and rotational movements will invariably arise at the instant the archer releases the drawn arrow.

One previous approach to increase bow stability is to increase or overweight the bow weight to reduce or alleviate transitional movements. One disadvantage of this approach is that the bow weight has been increased and such additional weight distracts from the fluid movements of drawing the string of a bow and shooting an arrow.

Another approach to increase bow stability is to affix weighted rods and vibration dampening or suppression systems to the bow or bow handle placed at various orientations to the bow handle. Early stabilizers consisted essentially of long aluminum rods threaded into the risers of the bow and weighted at the opposite rod end. Later versions relied upon carbon fiber composites in conjunction with a shock absorbing device. Most recently, stabilizers consist of multi-rod stabilizers with complex adjustment mechanisms or vibration dampening systems. One disadvantage of these approaches is that adjustability requires tools to reposition rod lengths and rod orientation and complex construction. Another disadvantage of this approach is that the additional weight of the rods and attachment and adjustment hardware and dampening systems distracts from the fluid movements of drawing the string of a bow and shooting an arrow as well as storage and transportation of the bow with additional rod extensions and the like.

Another approach to increase bow stability is to mount forearm rests to the bow to brace the forearm and the bow throughout target sighting, drawing and releasing of the archery arrow. One disadvantage of this approach is the added weight and bulkiness of the forearm rest distracts from the fluid movements of drawing the string of a bow and shooting an arrow as well as storage and transportation of the bow with additional forearm rests Therefore, it is readily apparent that there is a recognized unmet need for an arm stabilizer and methods of use, wherein such apparatus is not affixed to the bow, is light in weight, easy to transport, and quickly enables stabile drawing of the string of a bow and shooting an arrow accurately at a target.

BRIEF SUMMARY

Briefly described, in an example embodiment, the present apparatus and method overcomes the above-mentioned disadvantage, and meets the recognized need for an arm stabilizer and methods of use comprising, in general, a stretchable elastic member having a first end and a second end, an adjustable shoulder sling hingedly connected to the first end of the stretchable member, and a fixed hand sling hingedly connected to the second end of the stretchable member and, thus configured to be worn by a marksman with an extended aiming and firing arm and is not affixed to the firearm, is light in weight, easy to transport, and quick installation enables stabile aiming and firing accurately at a target.

In a preferred embodiment, arm stabilizer and methods of use, to be worn by a marksman about their back shoulder, back, and a hand of an extended arm, for stabilizing a firearm, the apparatus includes an elastic member having a first end and a second end, a shoulder sling hingedly connected to the first end of the elastic member, and a hand sling hingedly connected to the second end of the elastic member.

In still a further exemplary embodiment of the method of target sighting and firing a firearm F at a target, the method including the steps of providing an arm stabilizer apparatus, the apparatus having an elastic member having a first end and a second end, a shoulder sling hingedly connected to the first end of the elastic member, and a hand sling hingedly connected to the second end of the elastic member, positioning the arm stabilizer apparatus on a marksman, gripping the firearm in a hand of an extended arm, extending the hand and the extended arm from a front shoulder to position the firearm, stretching the elastic member to maintain a tension thereon the hand and the extended arm, and stabilizing the hand and the extended arm while target sighting the firearm.

Accordingly, the arm stabilizer and methods of use is its ability to be utilized with rifles, hand guns, shotguns, automatic weapons, sling shots, archery bows, crossbows, and like firearms.

Another feature of a feature of the arm stabilizer and methods of use is that it ability to not be affixed to the firearm, is light in weight, easy to transport, and quickly enables stabile aiming and accurate firing of a firearm at a target.

Still another feature of the arm stabilizer and methods of use is its ability to enable quick installation and/or efficiently use of the arm stabilizer while utilizing a firearm with an extended arm.

Yet another feature of the arm stabilizer and methods of use is its ability to provide stabile drawing of the string of a bow and shooting an arrow accurately at a target.

Yet another feature of the arm stabilizer and methods of use is its ability to reduce or counteract horizontal side-to-side forces or sway of the marksman's extended arm throughout target sighting and firing, especially when drawing and releasing of the archery arrow.

Yet another feature of the arm stabilizer and methods of use is its ability to reduce or counteract vertical up and down forces or sway of the marksman's extended arm throughout target sighting and firing, especially when drawing and releasing of the archery arrow.

Yet another feature of the arm stabilizer and methods of use is its ability to reduce or counteract translational and/or rotational movements of the marksman's extended arm throughout target sighting and firing, especially when drawing and releasing of the archery arrow.

Yet another feature of the arm stabilizer and methods of use is its ability to maintain tension on the marksman's extended arm throughout target sighting and firing, especially when drawing and releasing of the archery arrow.

Yet another feature of the arm stabilizer and methods of use is its ability to stabilize the firearm throughout target sighting and firing, especially when drawing and releasing of the archery arrow.

Yet another feature of the arm stabilizer and methods of use is its ability to stabilize the firearm during windy conditions.

Yet another feature of the arm stabilizer and methods of use is its ability to relieve stress on the fingers, hands, and wrists of the marksman.

Yet another feature of the arm stabilizer and methods of use is its ability to accommodate different sized firearms without the need for any special adapters or mounting plates.

Yet another feature of the arm stabilizer and methods of use is its ability to be utilized with other natural or manmade support utilized to assist target sighting and firing since this arm stabilizer does not add any protrusions to the firearm.

Yet another feature of the arm stabilizer and methods of use is its ability to tighten arrow or bullet target groupings.

Yet another feature of the arm stabilizer and methods of use is its ability to aid in the transport or support of the firearm.

Yet another feature of the arm stabilizer and methods of use is its ability to provide a low cost alternative to current firearm stabilizers and vibration dampening systems.

Yet another feature of the arm stabilizer and methods of use is its ability to be utilized with existing firearms without adapters or mounting devices.

Yet another feature of the arm stabilizer and methods of use is its ability to be easier, less expensive, and simpler to use than existing technology.

Yet another feature of the arm stabilizer and methods of use is its ability to stabilize a series of joints, such as the wrist joint, elbow joint, and shoulder joint of the extended arm by placing them under the tension of the elastic member.

Yet another feature of the arm stabilizer and methods of use is its ability to not be connected or affixed to the firearm, such as rifle, hand gun, shotgun, automatic weapon, sling shot, archery bow, crossbow, and other like firearms.

Yet another feature of the arm stabilizer and methods of use is its ability to be utilized by right hand or left hand shooters.

Yet another feature of the arm stabilizer and methods of use is its ability to be easily portable and light weight.

Yet another feature of the arm stabilizer and methods of use is its ability to maintain a solid shooting platform by creating a counteracting force or tension that creates a consistent and repeatable linear shooting position.

Yet another feature of the arm stabilizer and methods of use is its ability to enable a series of joints to move freely under tension, such as the wrist joint may pivot or rotate, elbow joint may bend or extend, and shoulder joint pivot or rotate.

These and other features of the an arm stabilizer and methods of use will become more apparent to one skilled in the art from the following Detailed Description of the Embodiments and Claims when read in light of the accompanying drawing Figures.

BRIEF DESCRIPTION OF THE DRAWINGS

The present arm stabilizer and methods of use will be better understood by reading the Detailed Description of the embodiments with reference to the accompanying drawing figures, in which like reference numerals denote similar structure and refer to like elements throughout, and in which.

Figure 1:
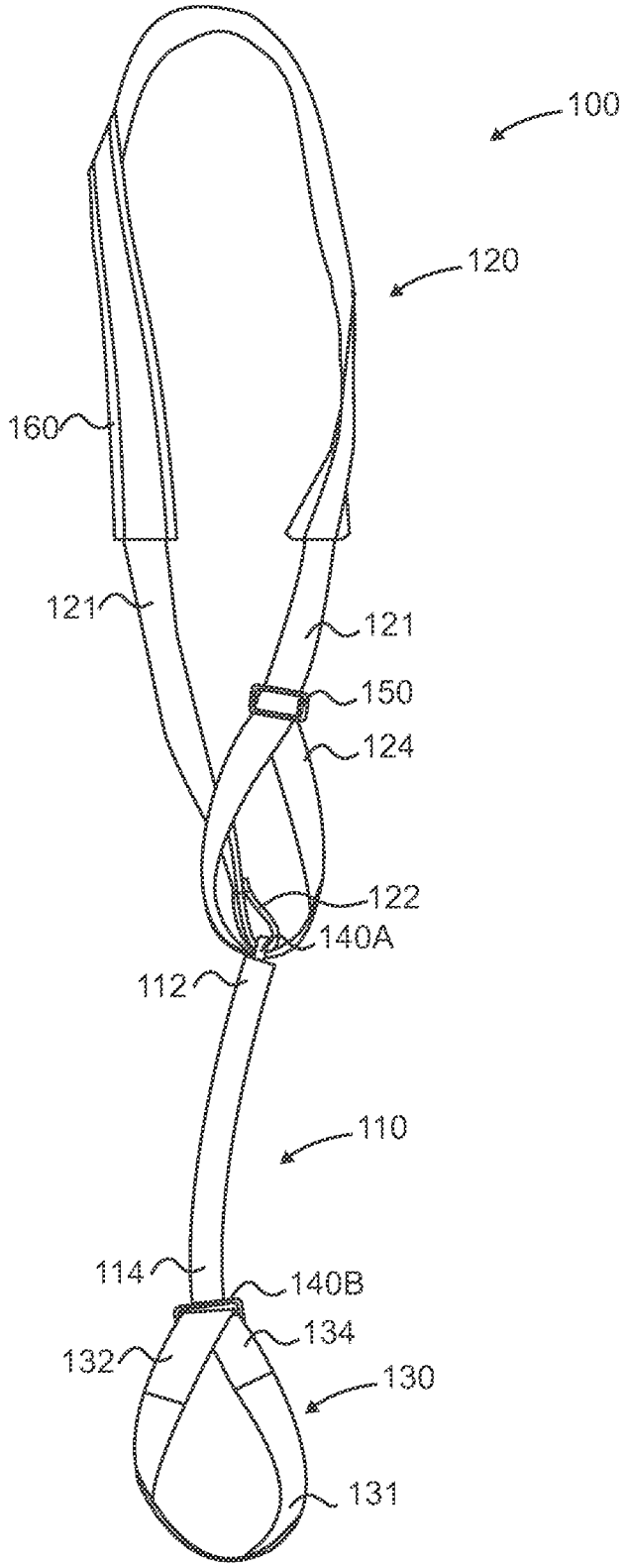
FIG. 1 is a perspective view of an example embodiment of arm stabilizer assembly.

It is to be noted that the drawings presented are intended solely for the purpose of illustration and that they are, therefore, neither desired nor intended to limit the disclosure to any or all of the exact details of construction shown, except insofar as they may be deemed essential to the claimed invention.

DETAILED DESCRIPTION

In describing the exemplary embodiments of the present disclosure, as illustrated in FIGS. 1-7 specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Referring now to FIGS. 1-7 by way of example, and not limitation, therein is illustrated an example embodiment arm stabilizer apparatus 100, wherein arm stabilizer apparatus 100 includes elastic member 110 having first end 112 and second end 114, shoulder sling 120 hingedly connected to first end 112 of elastic member 110 and hand sling 130 hingedly connected to second end 114 of elastic member 110. It is contemplated herein that arm stabilizer apparatus 100 may be utilized by a user U, such as a marksman M, in conjunction with operating a firearm F, such as rifle, hand gun, shotgun, automatic weapon, sling shot, archery bow B, crossbow, or the like firearm F, wherein such firearm F is held by marksman's M in their hand H of extended arm A under tension (retracting force from stretched elastic member 110) to stabilize such extended arm A throughout target sighting and firing, such as when drawing and releasing of the archery arrow AR.

Referring now to FIG. 1, by way of example, and not limitation, there is illustrated exemplary embodiment of arm stabilizer apparatus 100. Preferably, arm stabilizer apparatus 100 includes elastic member 110 having first end 112 and second end 114. Moreover, elastic member 110 preferably includes one or more transition brackets or buckle, such as buckle 140 and further such as first pin buckle 140A positioned proximate and affixed thereto first end 112 and second pin buckle 140B positioned proximate and affixed thereto second end 114 of elastic member 110. Buckle 140 is preferably formed of a suitable material, such as steel, aluminum, plastic, vinyl rubber, polyurethane, fiber, coated fiber or mesh, or the like, capable of providing structure to buckle 140. Preferably, the material includes other suitable characteristics, such as portable, light-weight, flexibility, durability, strength, water resistant, seal fluids therein, puncture resistant, tear resistant, rust-resistance, light weight, heat-resistance, chemical inertness, oxidation resistance, ease of workability, or other beneficial characteristic understood by one skilled in the art.

Figure 6:
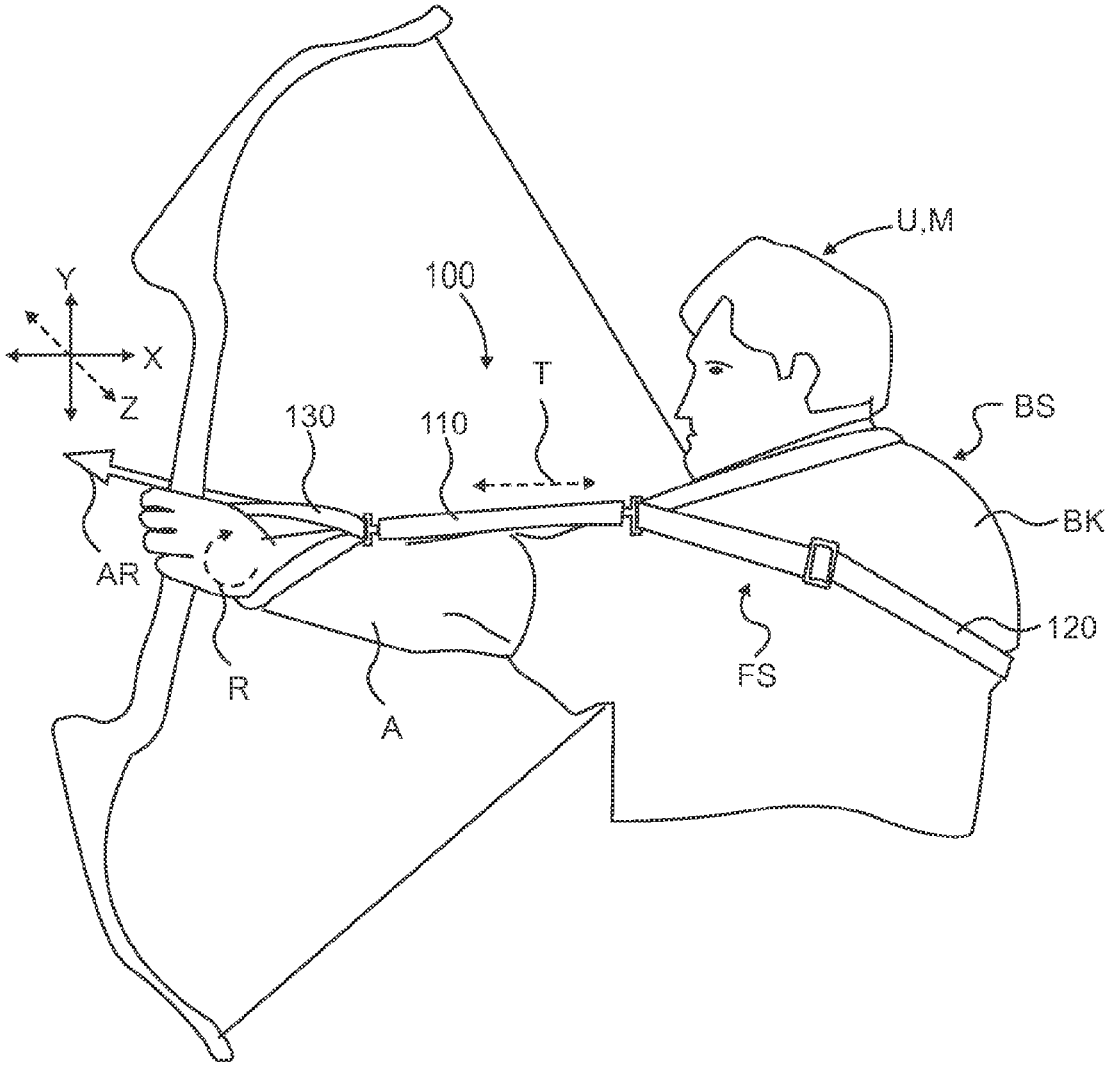
FIG. 6 is a side view of the arm stabilizer assembly of FIG. 1 shown worn by an archer drawing a bow string and arrow wherein the arm stabilizer assembly stabilizes an archer's bow.

Preferably buckle 140 is affixed thereto one for each of first end 112 and second end 114 of elastic member 110, first pin buckle 140A and second pin buckle 140B, respectively. Furthermore, arm stabilizer apparatus 100 preferably includes shoulder sling 120 hingedly connected to first end 112 of elastic member 110. Preferably shoulder sling 120 includes strap 121 having first shoulder strap end 122 and second shoulder strap end 124, wherein first shoulder strap end 122 is affixed thereto first pin buckle 140A of first end 112 of elastic member 110. First shoulder strap end 122 is preferably folded around first pin buckle 140A and sewn on to itself to affix first end 112 of elastic member 110 thereto first pin buckle 140A. Second shoulder strap end 124 is preferably inserted or fed back into and therethrough first pin buckle 140A of first end 112 of elastic member 110 to form shoulder sling 120, such as large loop and to enable size and length adjustment of shoulder sling 120. Preferably size and length adjustment of shoulder sling 120 is accomplished by inserting or feeding second shoulder strap end 124 through a slide mechanism, such as slide buckle 150, then second shoulder strap end 124 is preferably inserted or fed back into and through first pin buckle 140A of first end 112 of elastic member 110, and then second shoulder strap end 124 is preferably inserted or fed back again through slide buckle 150 to make an adjustable loop of strap 121 hinged about first pin buckle 140A of first end 112 of elastic member 110. It is contemplated herein that shoulder sling 120 may be adjusted to accommodate user U. Moreover, strap 121 may include widened or padded section 160 affixed to strap 121 and configured to increase the surface area of strap 121 and/or to lessen the pressure or dig of strap 121 into the shoulder S (front shoulder FS or back shoulder BS) or back BK of user U, such as a marksman M, in conjunction with operating a firearm F, as shown in FIG. 6.

It is contemplated herein that shoulder sling 120 hingedly connected to first end 112 of elastic member 110, wherein shoulder sling 120 and first pin buckle 140A of first end 112 of elastic member 110 is configured to enable elbow bending and extended arm A to swing, swinging, or pivoting from the shoulder.

It is still contemplated herein that free movement between shoulder sling 120, first pin buckle 140A and first end 112 of elastic member 110 and hand sling 130, second pin buckle 140B, and second end 114 of elastic member 110; create the combination smooth and automatic adjustment and full three dimensional wrist rotation, elbow bending and extension, and extended arm swing pivoting under tension T to create a stable, repeatable, and consistent linear shooting position of hand H and/or extended arm A throughout positioning, target sighting and firing, such as when drawing and releasing of the archery arrow AR, whereby increasing the accuracy of firearm F.

Still furthermore, arm stabilizer apparatus 100 preferably includes hand sling 130 hingedly connected to second end 114 of elastic member 110. Preferably hand sling 130 includes strap 131 having first hand strap end 132 and second hand strap end 134, wherein first hand strap end 132 is preferably inserted or fed back into and through second pin buckle 140B of second end 114 of elastic member 110 and second hand strap end 134 is preferably inserted or fed back into and through second pin buckle 140B of second end 112 of elastic member 110 to form hand sling 130, such as small loop.

It is contemplated herein that hand sling 130 hingedly connected to second end 114 of elastic member 110, wherein hand sling 130 and second pin buckle 140B of second end 114 of elastic member 110 is configured to enable hinged connection which enables full three dimensional wrist rotation, elbow bending, and extended arm swing pivoting from the shoulder.

Shoulder sling 120, which includes strap 121 having first shoulder strap end 122 and second shoulder strap end 124 and hand sling 130, which includes strap 131 having first hand strap end 132 and second hand strap end 134 are preferably formed of a suitable material or fabric, such as vinyl, canvas, plastic, rubber, polyurethane, fiber, coated fiber or mesh, nylon, Tyvek, spandex, or the like, capable of providing structure to shoulder sling 120 and hand sling 130. Preferably, the material includes other suitable characteristics, such as flexibility, durability, strength, water resistant, seal fluids therein, puncture resistant, tear resistant, rust-resistance, light weight, heat-resistance, chemical inertness, oxidation resistance, ease of workability, or other beneficial characteristic understood by one skilled in the art.

It is further contemplated herein that arm stabilizer apparatus 100 may be configured, adjusted, and/or sized (adjusting shoulder sling 120) to accommodate various sized marksman M.

Figure 2:
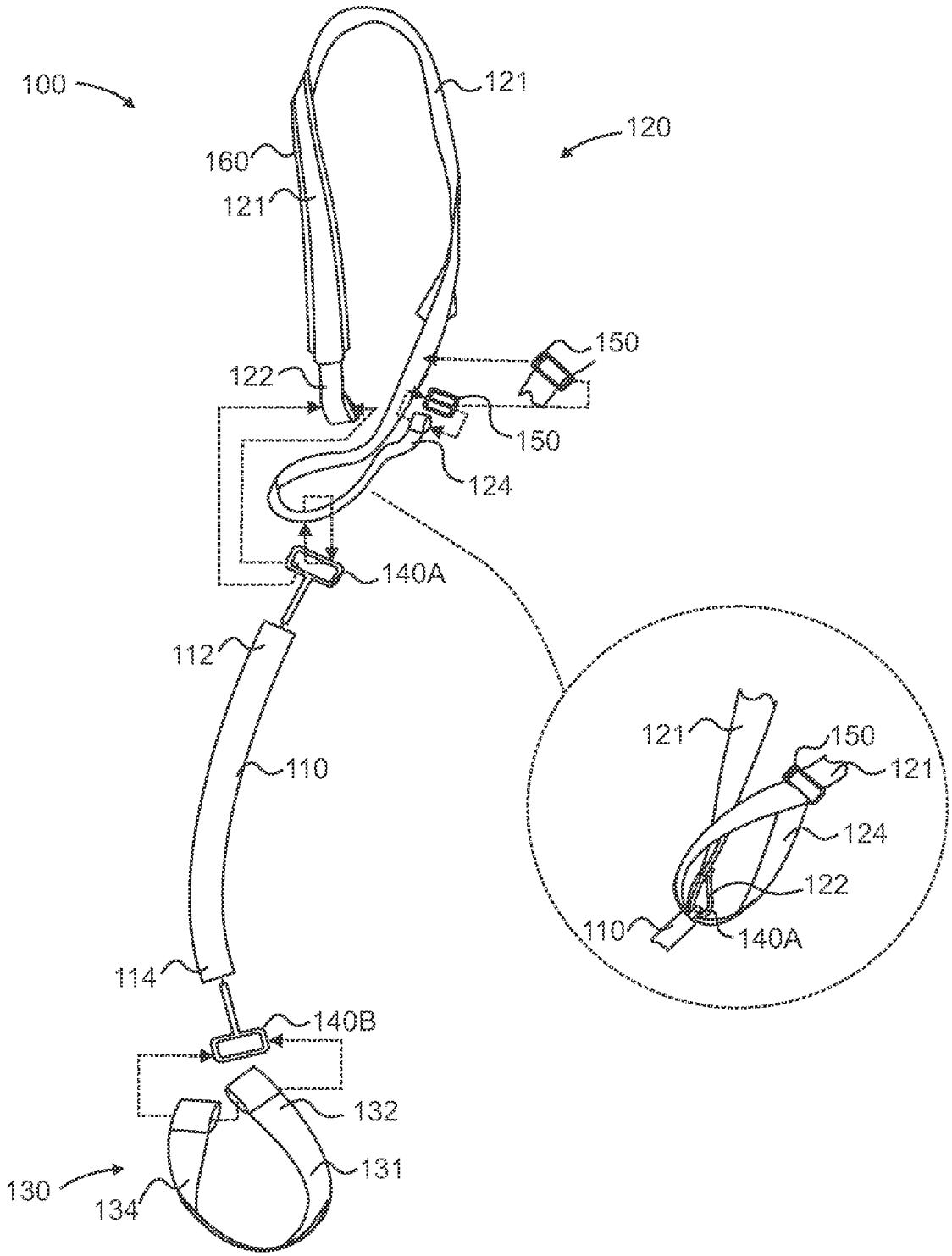
FIG. 2 is an exploded perspective view of the arm stabilizer assembly of FIG. 1.

Referring now to FIG. 2, by way of example, and not limitation, there is illustrated exemplary exploded embodiment having arrows between connected parts of arm stabilizer apparatus 100, wherein arm stabilizer apparatus 100 includes elastic member 110 having first end 112 and second end 114, a pair of transition brackets or buckles, such as buckle 140, having first pin buckle 140A positioned proximate and affixed thereto first end 112 and second pin buckle 140B positioned proximate and affixed thereto second end 114 of elastic member 110. In addition, arm stabilizer apparatus 100 preferably includes shoulder sling 120 having strap 121, which includes first shoulder strap end 122 and second shoulder strap end 124, wherein first shoulder strap end 122 is affixed thereto first pin buckle 140A of first end 112 of elastic member 110 and second shoulder strap end 124 preferably forms a loop and is preferably inserted or is fed back into and through first pin buckle 140A of first end 112 of elastic member 110 to enable size and length adjustment of shoulder sling 120 accomplished by inserting or feeding second shoulder strap end 124 through a slide mechanism, such as slide buckle 150. Moreover, arm stabilizer apparatus 100 preferably includes hand sling 130 having strap 131, which includes first hand strap end 132 and second hand strap end 134, wherein first hand strap end 132 and second hand strap end 134 is preferably inserted or is fed back into and through second pin buckle 140B of second end 114 of elastic member 110 and folded and sewn to affix first hand strap end 132 and second hand strap end 134 in a small loop hingedly connected to second pin buckle 140B of second end 114 of elastic member 110.

Figure 3:
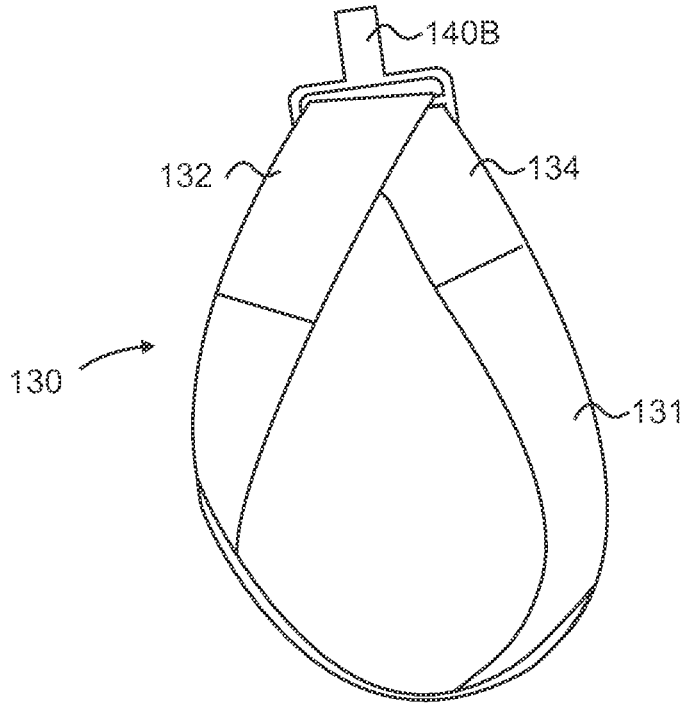
FIG. 3 is a perspective view of an example embodiment of the hand strap of the arm stabilizer assembly of FIG. 1.

Referring now to FIG. 3, by way of example, and not limitation, there is illustrated exemplary embodiment of hand sling 130 and second pin buckle 140B. Preferably hand sling 130 includes strap 131 having first hand strap end 132 and second hand strap end 134, wherein first hand strap end 132 is preferably inserted or fed back into and through second pin buckle 140B of second end 114 of elastic member 110 and second hand strap end 134 preferably forms a small loop and inserts or feeds back into and through second pin buckle 140B of second end 112 of elastic member 110. First hand strap end 132 and second hand strap end 134 is preferably sewn on to the other end of strap 131 to affix first hand strap end 132 and second hand strap end 134 around second pin buckle 140B of second end 114 of elastic member 110 to create a figure eight (8) sewn loop around second pin buckle 140B of second end 114 of elastic member 110. It is contemplated herein that such figure eight (8) sewn loop or crisscross sewing pattern reduces the pressure point of hand sling 130 on hand H.

It is contemplated herein that hand sling 130 may include a form fitting pad or device to accommodate user's U hand and firearm F. It is further contemplated herein that first hand strap end 132 and second hand strap end 134 may be folded and sewn on to themselves to affix first hand strap end 132 and second hand strap end 134 to second pin buckle 140B of second end 114 of elastic member 110, as shown in FIG. 2. It is still further contemplated herein that first hand strap end 132 and second hand strap end 134 may be folded and sewn on to each other to affix first hand strap end 132 and second hand strap end 134 to second pin buckle 140B of second end 114 of elastic member 110 to create a figure eight (8) loop around second pin buckle 140B of second end 114 of elastic member 110, as shown in FIG. 3.

Figure 4:
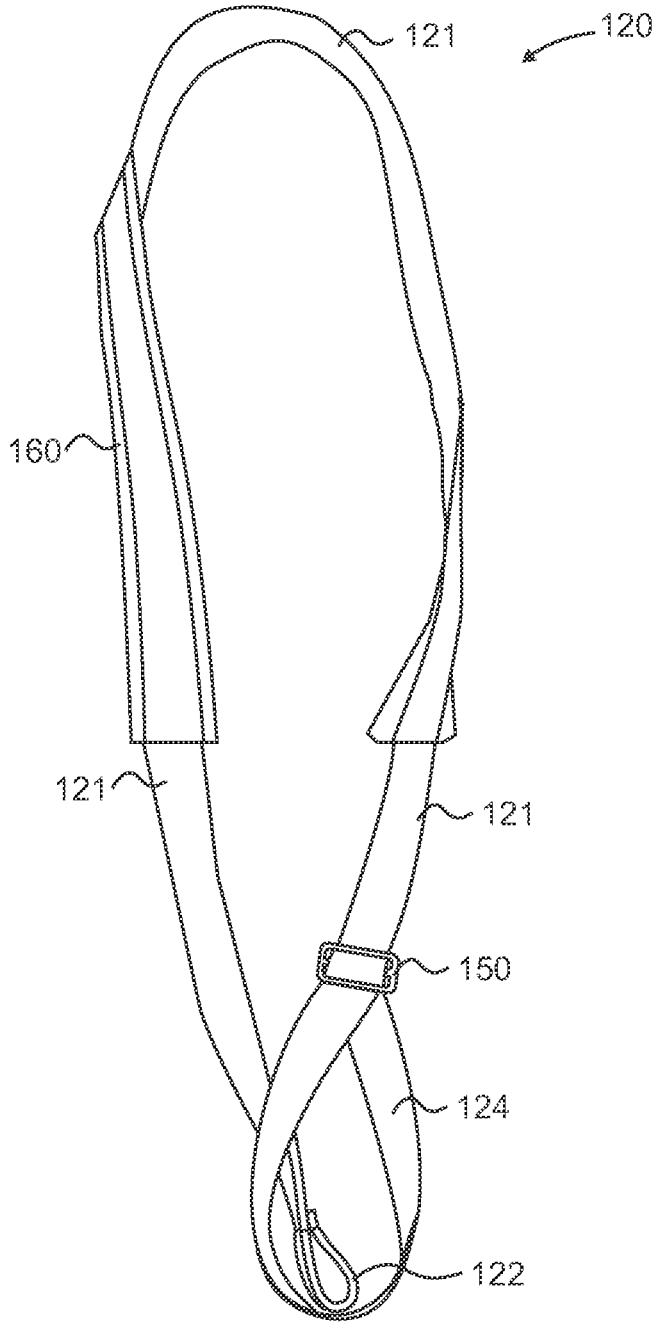
FIG. 4 is a perspective view of an example embodiment of the shoulder strap of the arm stabilizer assembly of FIG. 1.

Referring now to FIG. 4, by way of example, and not limitation, there is illustrated exemplary embodiment of shoulder sling 120. Preferably shoulder sling 120 includes strap 121 having first shoulder strap end 122 and second shoulder strap end 124. First shoulder strap end 122 is preferably folded and sewn on to itself to affix first end 112 of elastic member 110 thereto first pin buckle 140A, shown in FIG. 1. Second shoulder strap end 124 preferably forms a large loop and is preferably inserted or fed through a slide mechanism, such as slide buckle 150, and then forms small adjustable loop and is preferably inserted or fed again through slide bracket 150 to make an adjustable loop of strap 121. Moreover, strap 121 may include widened or padded section 160 configured to increase the surface area of strap 121 and/or to lessen the pressure or dig of strap 121 into the shoulder S (front shoulder FS or back shoulder BS) or back BK of user U, such as a marksman M, in conjunction with operating a firearm F, as shown in FIG. 6.

Figure 5:
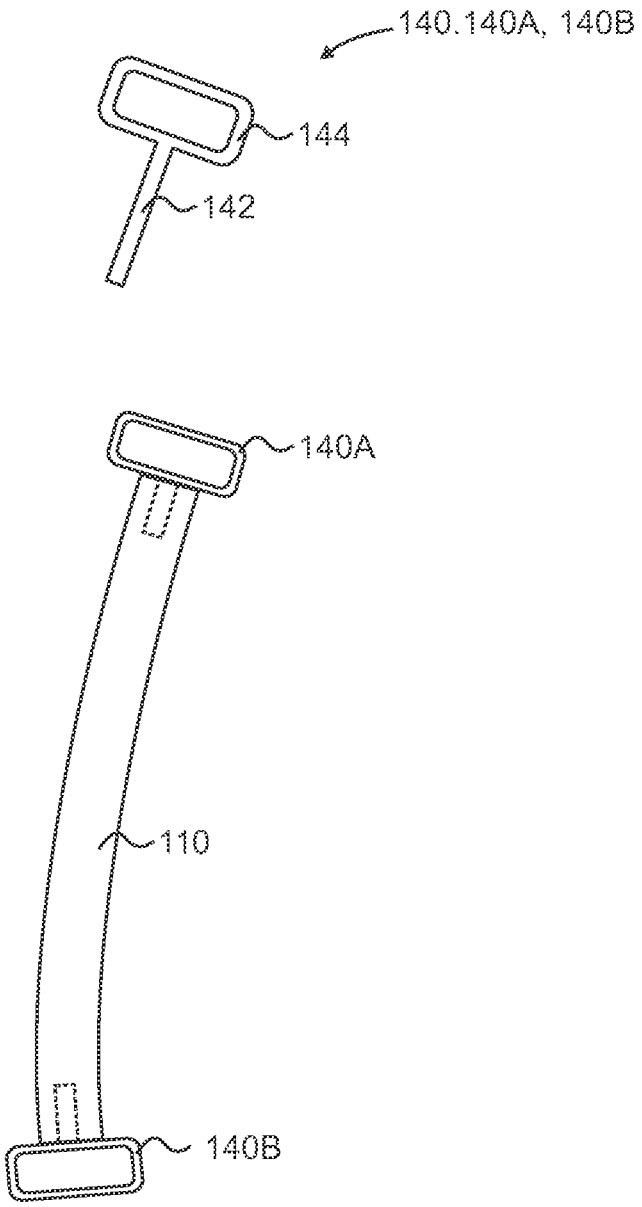
FIG. 5 is a perspective view of an example embodiment of the rubber tension tubing of the arm stabilizer assembly of FIG. 1.

Referring now to FIG. 5, by way of example, and not limitation, there is illustrated exemplary embodiment of elastic member 110. Preferably elastic member 110 includes first end 112 and second end 114. Moreover, elastic member 110 preferably includes one or more transition brackets or buckle, such as buckle 140, and furthermore such as first pin buckle 140A positioned proximate and affixed thereto first end 112 and second pin buckle 140B positioned proximate and affixed thereto second end 114 of elastic member 110. Preferably buckle 140 is affixed thereto one for each of first end 112 and second end 114 of elastic member 110, such as first pin buckle 140A and second pin buckle 140B, respectively. Preferably buckle 140 includes pin 142 and buckle 144, wherein pin 142 of first pin buckle 140A and second pin buckle 140B is preferably inserted therein each of first end 112 and second end 114 of elastic member 110. Pin 142 is preferably affixed to first end 112 and second end 114 of elastic member 110 by an adhesive, welding or other like bond.

Preferably elastic member 110 is formed of a suitable stretchy and flexible material or fabric, such as rubber tubing, spandex or the like. Preferably, the material includes other suitable characteristics, such as flexibility, durability, strength, water resistant, puncture resistant, tear resistant, light weight, heat-resistance, chemical inertness, oxidation resistance, ease of workability, or other beneficial characteristic understood by one skilled in the art. It is further contemplated herein that elastic member 110 may be configured and/or sized to accommodate various size and strength marksman M and their firearms F of choice.

It is contemplated herein that buckle 144/150 may be positioned proximate and affixed thereto each end, first end 112 and second end 114 of elastic member 110, such as spandex fabric, and folded around buckle 144/150 and sewn on to itself to affix thereto buckle 144/150, one buckle 144/150 for each of first end 112 and second end 114 of elastic member 110.

Referring now to FIG. 6, by way of example, and not limitation, there is illustrated exemplary embodiment of arm stabilizer apparatus 100 shown in use. In use, user U, such as a marksman M positions, fits or puts on arm stabilizer apparatus 100 by inserting hand H of extended arm A into hand sling 130 and gripping hand sling 130 or marksman grips hand sling 130. It is recognized that hand sling 130 may be utilized by right hand or left hand marksman M. Next marksman M inserts their other hand and arm through shoulder sling 120. Next, arm stabilizer apparatus 100 is preferably lifted overhead as marksman's M other hand and arm slide into shoulder sling 120 to enable shoulder sling 120 to rest looped around back shoulder BS, rest against back BK and over front shoulder FS, elastic member 110 to rest against and proximate extended arm A, and hand sling 130 looped around hand H of extended arm A (positioning of apparatus 100 on user U, such as a marksman M).

In operation marksman's M extends extended arm A under tension T of elastic member 110 and such tension T stabilize a series of joints of extended arm A in a linear line, such as parallel to archery arrow AR, such as the wrist joint, elbow joint, and shoulder joint of the extended arm A throughout target sighting and firing, such as when drawing and releasing of the archery arrow AR. Moreover, marksman's M extended arm A under tension T of elastic member 110 to stabilize such extended arm A and reduces and/or counteracts horizontal side-to-side forces or sway of the marksman's extended arm A, x-axis X, vertical up and down forces or sway of the marksman's extended arm A, y-axis Y, and/or translational and/or rotational movements, z-axis Z throughout target sighting and firing, such as when drawing and releasing of the archery arrow AR. Preferably arm stabilizer apparatus 100 creates a shooting platform with a consistent and linear repeatable shooting position of hand H and/or extended arm A throughout target sighting and firing, such as when drawing and releasing of the archery arrow AR, whereby increasing the accuracy of firearm F.

It is contemplated herein that elastic member 110 maintains tension T thereon hand H and/or extended arm A throughout target sighting and firing, such as when drawing and releasing of the archery arrow AR and such tension T increases the stability and steadiness of firearm F and therefore the accuracy of executing firearm F.

It is contemplated herein that elastic member 110 maintains tension T thereon hand H and/or extended arm A to assist or aid to support firearm F.

Figure 7:
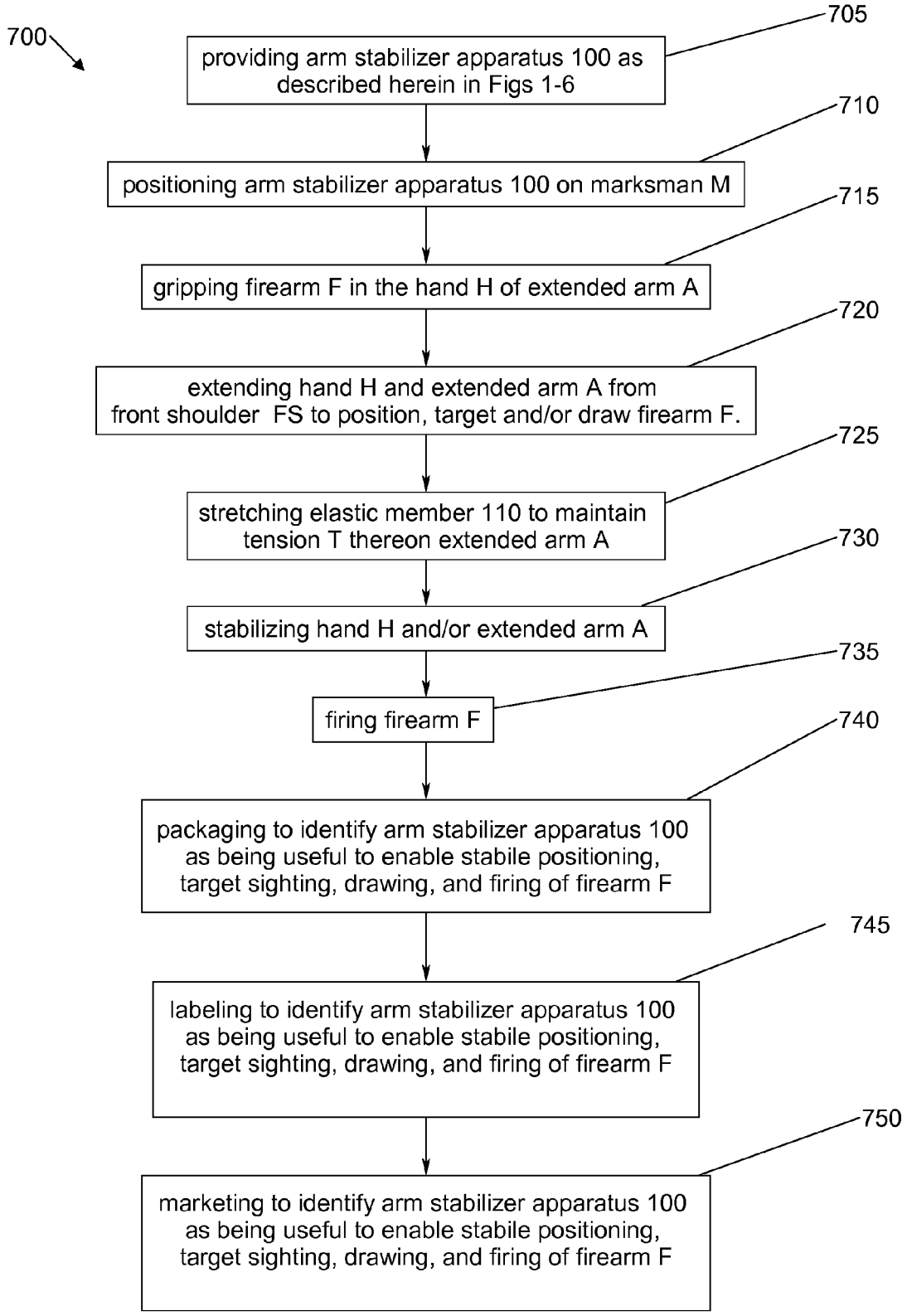
FIG. 7 is a flow diagram of a method of marketing, packaging, and utilizing the arm stabilizer assembly of FIG. 1.

It is contemplated herein that elastic member 110 series of joints to move freely under tension, such as the wrist joint may pivot or rotate, elbow joint may bend or extend, and shoulder joint pivot or rotate Referring now to FIG. 7, there is illustrated a flow diagram 700 of a method of providing, marketing, positioning, target sighting, and firing a firearm F, drawing and releasing of the archery arrow AR utilizing arm stabilizer apparatus 100 as described herein in FIGS. 1-6. In block or step 705, providing arm stabilizer apparatus 100 as described herein in FIGS. 1-6. In block or step 710, positioning arm stabilizer apparatus 100 on marksman M, as disclosed in FIG. 6 description. In block or step 715, gripping firearm F in hand H of extended arm A, as shown in FIG. 6. In block or step 720, extending hand H and extended arm A from front shoulder FS to position, target and/or draw firearm F. Elastic member 110 of arm stabilizer apparatus 100 operates in a push push-pull system when drawing firearm F, such as bow B and causes a counter-acting force, tension T, against the hand H and extended arm A drawing firearm F, such as bow B. In block or step 725, stretching elastic member 110 to maintain tension T thereon extended arm A throughout positioning, target sighting and/or drawing of firearm F, such as bow B. In block or step 730, stabilizing hand H and/or extended arm A throughout positioning, target sighting and/or drawing of firearm F, such as bow B. Preferably, stretching elastic member 110 to maintain tension T thereon hand H and extended arm A stabilizes and steadies hand H and extended arm A to reduce and/or counteract horizontal side-to-side forces or sway of the marksman's hand H and/or extended arm A, x-axis X, vertical up and down forces or sway of the marksman's hand H and/or extended arm A, y-axis Y, and/or translational and/or rotational movements, z-axis Z throughout positioning, target sighting and drawing firearm F, such as when drawing archery arrow AR. In block or step 735, firing firearm F and accurately discharging firearm F on the target. Target herein is a point, object or goal at which something else, such as archery arrow AR or firearm bullet is directed. Preferably arm stabilizer apparatus 100 creates a shooting platform with a consistent and repeatable linear shooting position of hand H and/or extended arm A throughout target sighting and firing, such as when drawing and releasing of the archery arrow AR, whereby increasing the accuracy of firearm F. Moreover, hinge points, such as buckle 140, first pin buckle 140A and second pin buckle 140B, and stretching elastic member 110 enable hand H to come to its natural shooting position while positioning, target sighting and drawing firearm F.

In block or step 740, packaging to identify arm stabilizer apparatus 100 as being useful to enable stabile positioning, target sighting, drawing, and firing of firearm F. In block or step 745, labeling to identify arm stabilizer apparatus 100 as being useful to enable stabile positioning, target sighting, drawing, and firing of firearm F. In block or step 750, marketing to identify arm stabilizer apparatus 100 as being useful to enable stabile positioning, target sighting, drawing, and firing of firearm F.

The foregoing description and drawings comprise illustrative embodiments of the present invention. Having thus described exemplary embodiments, it should be noted by those ordinarily skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one ordinarily skilled in the art to which this invention pertains having the benefit of the teachings presented in the foregoing descriptions and the associated drawings. Although specific terms may be employed herein, they are used in a generic and descriptive sense only and not for purposes of limitation. Moreover, the present invention has been described in detail; it should be understood that various changes, substitutions and alterations can be made thereto without departing from the spirit and scope of the invention as defined by the appended claims. Accordingly, the present invention is not limited to the specific embodiments illustrated herein, but is limited only by the following claims.

What is claimed is:

1. An apparatus, worn by a marksman about their back shoulder, back, and a hand of an extended arm, for stabilizing a firearm, the apparatus comprising:

an elastic member having a first end and a second end;

a shoulder sling hingedly connected to said first end of said elastic member via a first pin buckle, said first pin buckle includes a first pin inserted in said first end of said elastic member and a first buckle hingedly connected to said shoulder sling;

said shoulder sling includes a first shoulder strap end and a second shoulder strap end forming a loop, said first shoulder strap end is configured to be affixed thereto said first buckle and inserted through the loop of said second should strap end; and a hand sling hingedly connected to said second end of said elastic member via a second pin buckle, said second pin buckle includes a second pin inserted in said second end of said elastic member and a second buckle hingedly connected to said hand sling;

said hand sling includes a first hand strap end and a second hand strap end, said first hand sling is inserted through the second buckle and said first hand strap end is affixed to said second hand strap end to form a sewn loop in a crisscross pattern;

wherein the marksman drips the firearm and said hand sling in the hand of the extended arm under tension of said elastic member.

2. The apparatus of claim 1, wherein said shoulder sling further comprises a padded section affixed to said shoulder sling.

3. The apparatus of claim 1, wherein said shoulder sling further comprises a slide buckle wherein said second shoulder strap end is further configured to be inserted therethrough said slide buckle to enable length adjustment of said shoulder sling.

4. A method of target sighting and firing a firearm F at a target, said method comprising the steps of:

providing an arm stabilizer apparatus, said apparatus having:

an elastic member having a first end and a second end;

a shoulder sling hingedly connected to said first end of said elastic member via a first pin buckle, said first pin buckle includes a first pin inserted in said first end of said elastic member and a first buckle hingedly connected to said shoulder sling;

said shoulder sling includes a first shoulder strap end and a second shoulder strap end forming a loop, said first shoulder strap end is configured to be affixed thereto said first buckle and inserted through the loop of said second should strap end; and a hand sling hingedly connected to said second end of said elastic member via a second pin buckle, said second pin buckle includes a second pin inserted in said second end of said elastic member and a second buckle hingedly connected to said hand sling;

said hand sling includes a first hand strap end and a second hand strap end, said first hand sling is inserted through the second buckle and said first hand strap end is affixed to said second hand strap end to form a sewn loop in a crisscross pattern;

wherein the marksman grips the firearm and said hand sling in the hand of the extended arm under tension of said elastic member;

positioning said arm stabilizer apparatus on a marksman;

gripping the firearm in a hand of an extended arm; and extending said hand and said extended arm from a front shoulder to position the firearm F;

stretching said elastic member to maintain a tension thereon said hand and said extended arm; and stabilizing said hand and said extended arm while target sighting the firearm.

5. The method of claim 4, further comprising the step of firing the firearm.

6. The method of claim 5, further comprising the step of accurately discharging the firearm on the target.

7. The method of claim 6, further comprising the step of creating a shooting platform having a linear repeatable shooting position for said hand and said extended arm.

8. The method of claim 7, further comprising the step of packaging the apparatus to identify the apparatus as being useful to enable stabile positioning, target sighting, drawing, and firing of the firearm.

9. The method of claim 7, further comprising the step of labeling the apparatus to identify the apparatus as being useful to enable stabile positioning, target sighting, drawing, and firing of the firearm.

10. The method of claim 7, further comprising the step of marketing the apparatus to identify the apparatus as being useful to enable stabile positioning, target sighting, drawing, and firing of the firearm.

11. The method of claim 5, further comprising the step of bending said extended arm under said tension.

12. The method of claim 5, further comprising the step of swinging said extended arm under said tension.

13. The method of claim 5, further comprising the step of adjusting said shoulder sling to accommodate various sized marksman.

14. The method of claim 5, further comprising the step of rotating said hand under said tension.

* * * * *